US007552563B2

(12) United States Patent
Becker

(10) Patent No.: US 7,552,563 B2
(45) Date of Patent: Jun. 30, 2009

(54) COLLAPSIBLE STRUCTURE

(75) Inventor: Robert J. Becker, 3275 Revere Rd., Richfield, OH (US) 44286

(73) Assignee: Robert J. Becker, Richfield, OH (US)

( * ) Notice: Subject to any disclaimer, the term of this patent is extended or adjusted under 35 U.S.C. 154(b) by 0 days.

(21) Appl. No.: 10/446,899

(22) Filed: May 28, 2003

(65) Prior Publication Data

US 2004/0031211 A1 Feb. 19, 2004

(51) Int. Cl.
*E04B 1/344* (2006.01)
*B65D 5/36* (2006.01)
*B65D 5/10* (2006.01)

(52) U.S. Cl. ..... 52/79.5; 229/108; 229/117.06; 229/156; 229/157; 52/71; 446/478; 446/488

(58) Field of Classification Search ..... 52/71, 52/64, 66, 70, 79.5; 446/478, 487, 488; 119/431, 119/474, 492, 498, 514, 168; 220/6, 7; 229/117.01, 229/117.05, 117.06, 116.04, 156, 157, 108, 229/108.1, 213
See application file for complete search history.

(56) References Cited

U.S. PATENT DOCUMENTS 502,457 A * 8/1893 Lazure ..... 229/116.4
536,162 A * 3/1895 Stiefel ..... 229/116.4
1,386,423 A * 8/1921 Rapson ..... 446/478
1,899,241 A * 2/1933 Marr ..... 446/79
1,918,375 A * 7/1933 Bowersock et al. ..... 52/71
2,636,313 A * 4/1953 Shank ..... 446/79
3,039,670 A * 6/1962 Hardon ..... 206/521.8
3,116,868 A * 1/1964 Lazure ..... 229/101.2
3,134,708 A * 5/1964 Lohnes ..... 428/9
3,280,796 A * 10/1966 Hatcher ..... 119/499
3,310,220 A * 3/1967 Feldman ..... 229/101
3,371,842 A * 3/1968 Hechtmann et al. ..... 229/101
3,643,858 A * 2/1972 Deckys ..... 229/72
3,977,119 A * 8/1976 Nelson ..... 446/478
4,006,670 A * 2/1977 Royal ..... 493/10
4,131,227 A * 12/1978 Patton et al. ..... 229/116.4
4,136,817 A * 1/1979 Perry ..... 229/101
4,190,978 A * 3/1980 Nelson ..... 446/478
4,238,068 A * 12/1980 Ellerbe et al. ..... 229/101
4,391,223 A * 7/1983 Holland et al. ..... 119/499
4,603,658 A * 8/1986 Garnsey ..... 119/499
4,792,082 A * 12/1988 Williamson ..... 229/103
4,940,016 A * 7/1990 Heath ..... 119/168
4,940,200 A * 7/1990 Sawyer et al. ..... 248/97
5,071,062 A * 12/1991 Bradley et al. ..... 229/109
5,264,996 A * 11/1993 Bele et al. ..... 362/162
5,301,478 A * 4/1994 Maese, Jr. ..... 52/66

(Continued)

FOREIGN PATENT DOCUMENTS

JP 5-209436 * 8/1993

(Continued)

*Primary Examiner*—Robert J Canfield
*Assistant Examiner*—Christine T Cajilig
(74) *Attorney, Agent, or Firm*—Renner Otto Boisselle & Sklar LLP

(57) ABSTRACT

A collapsible structure having walls and hinges, the walls being foldable to reduce the volume of the collapsible structure via hinges separated by a distance to form pockets which receive therein the thickness of one or more collapsed walls.

19 Claims, 17 Drawing Sheets

U.S. PATENT DOCUMENTS 5,313,747 A * 5/1994 Sakihara ..... 52/64
5,320,065 A * 6/1994 Leopold ..... 119/498
5,383,422 A * 1/1995 Morris ..... 119/499
5,396,864 A * 3/1995 Mannschreck ..... 119/174
5,458,521 A * 10/1995 Todd ..... 446/73
5,465,686 A * 11/1995 Monetti et al. ..... 119/168
5,752,470 A * 5/1998 Koneke ..... 119/499
5,865,140 A * 2/1999 McGivern ..... 119/168
5,934,474 A * 8/1999 Renninger et al. ..... 206/600
6,050,410 A * 4/2000 Quirion ..... 206/386
6,108,982 A * 8/2000 Davison ..... 52/64
6,138,901 A * 10/2000 Kim et al. ..... 229/101
6,440,050 B1 * 8/2002 Capparelli et al. ..... 493/59
6,478,216 B2 * 11/2002 Wiart ..... 229/101
6,698,382 B1 * 3/2004 Blaszak et al. ..... 119/168
7,025,019 B2 * 4/2006 Axelrod et al. ..... 119/499
7,229,001 B2 * 6/2007 Wang ..... 229/117.05

FOREIGN PATENT DOCUMENTS

WO 94/18822 * 9/1994

* cited by examiner

COLLAPSIBLE STRUCTURE

FIELD OF THE INVENTION

The present invention relates to a collapsible structure and, more particularly, to a collapsible structure including hinged walls which may be folded relative to one another for compactness or versatility.

BRIEF DESCRIPTION OF DRAWINGS

FIG. 14E shows a perspective view of the FIG. 14A structure in a final collapsed form.

DETAILED DESCRIPTION

Figure 1B:
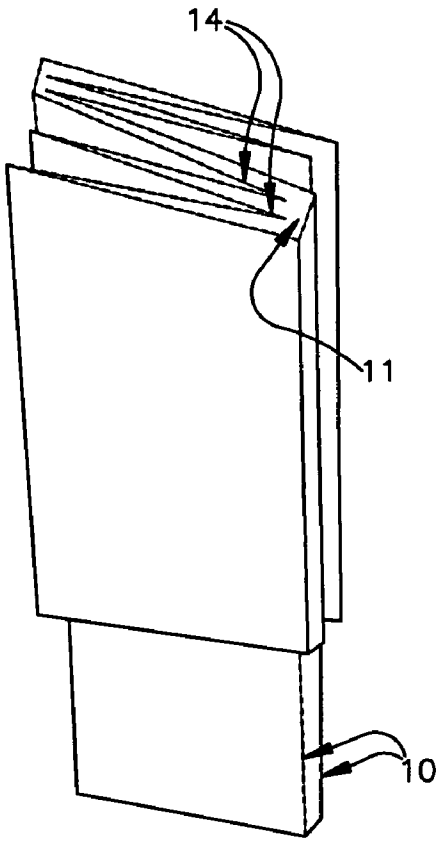
FIG. 1B shows the FIG. 1 structure in its collapsed form.
Figure 1A:
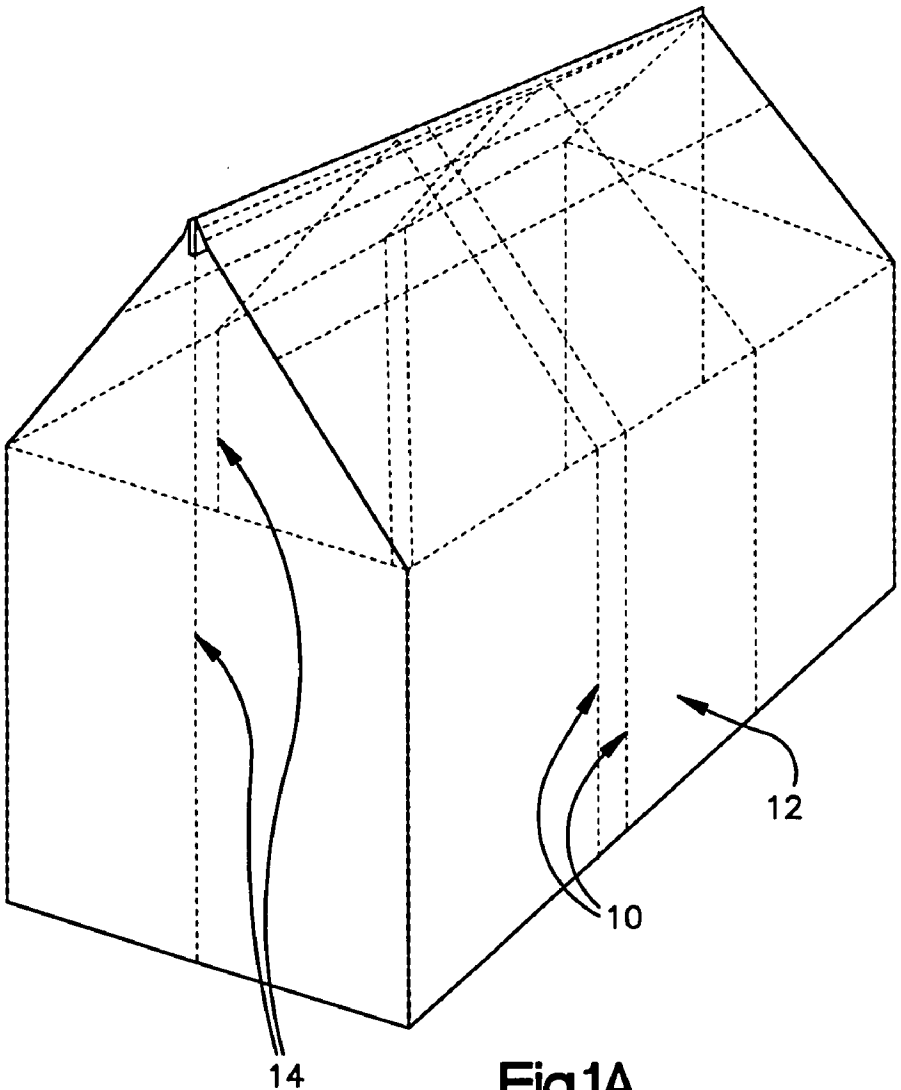
FIG. 1A shows a collapsible structure in accordance with the invention, with dashed lines representing hinges.

FIG. 1A shows a collapsible structure in accordance with the present invention. The collapsible structure easily collapses to a significantly smaller collapsed form, for example, as shown in FIG. 1B. This is accomplished by providing hinges 10 between sections 12 which, when the sections are bent about the hinges 10, create a pocket 11 between the hinges 10 (illustrated in FIG. 1B) to accommodate narrower sections collapsed about a hinge 14.

Figure 2B:
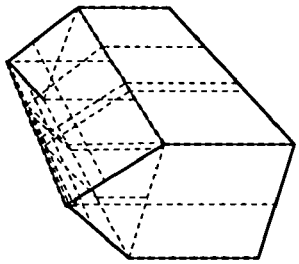
FIG. 2B shows the FIG. 1 structure with its roof assembled to form a gable roof style.
Figure 2C:
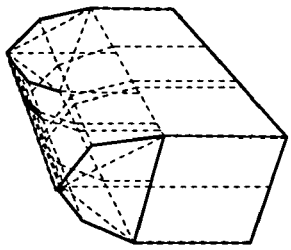
FIG. 2C shows the FIG. 1 structure with its roof assembled to form a gambrel roof style.
Figure 2A:
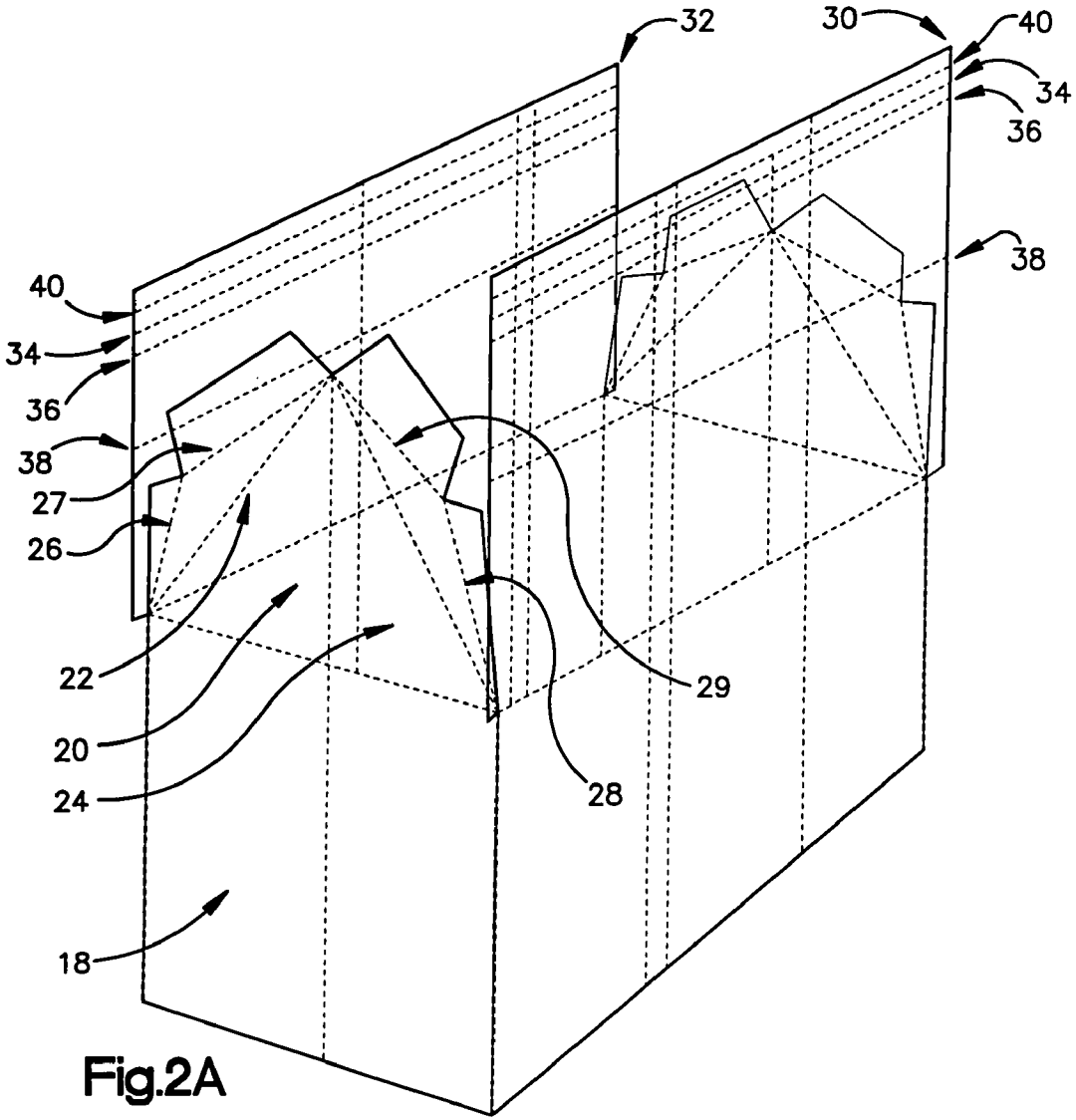
FIG. 2A shows the FIG. 1 structure with its roof open.

The collapsible structure is capable of being erected to have different roof styles. The roof is shown open in FIG. 2A. The roof may be assembled to have a gable style, as shown in FIG. 2B or a gambrel style, as shown in FIG. 2C. This is accomplished by configuring the end wall 18 that supports the roof panels 30, 32.

Since the end wall panel 18 is of a fixed height, the linear distance between the peak of the roof and tops of the side walls and, accordingly, the surface area of the roof will decrease as the upper portions of the panels are reconfigured from a gambrel FIG. 2C to gable FIG. 2B roof. The roof panels 30, 32 have hinges 34 and 36 to enable the roof panels length to be adjusted accordingly. Hinge 38 enables the roof sections to be straight for a gable configuration FIG. 2B or bent for a gambrel FIG. 2C roof-line. The roof panels 30, 32 can also include additional hinges 40 which when bent increase the structural integrity of the roof as well as serve as a means for applying fastening means if so desired.

The upper portions 20 of the end walls 18 have multiple hinges. Hinges 22 and 24 may be used to create a gable roof line. Alternatively hinges 26, 27, 28, and 29 may be used to create the gambrel roof line. The upper portion of end wall opposite to the upper portion 20 of end wall 18 has the same hinge configuration to support the other end of roof panels 30, 32.

The structure can be manufactured from a variety of materials either plain or laminated or finished such as wood, steel, fiberboard, plastic, fabric covered frame, coated material, for example, dry erase style surface and waterproofing.

Although the invention is described chiefly as a collapsible playhouse structure it will be appreciated by those skilled in the art that the invention may be used for creating other collapsible structures such as temporary shelters, animal shelters, theaters, playhouses, greeting cards and advertising displays.

Figure 3:
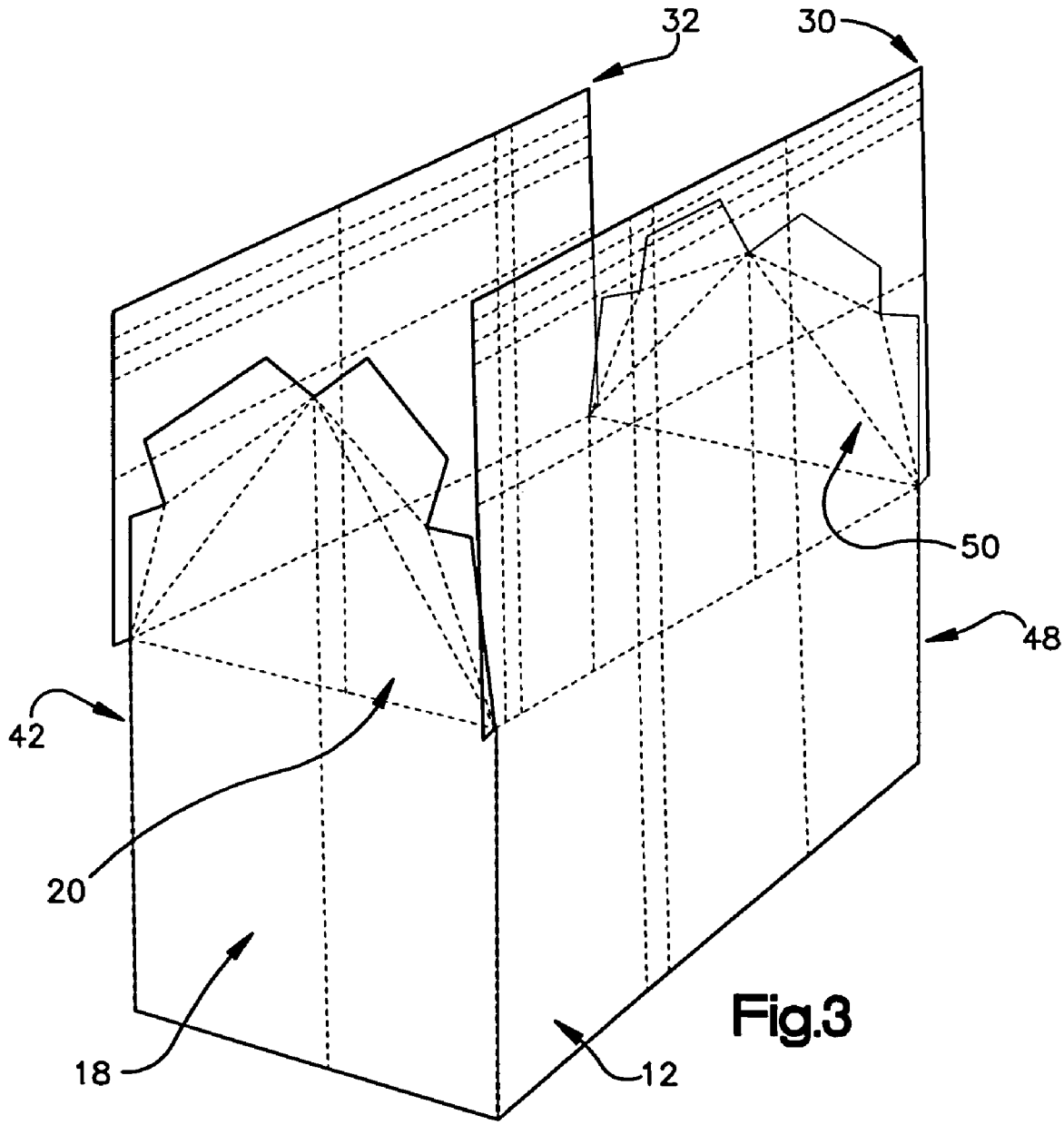
FIG. 3 shows the FIG. 1 structure with its roof open, and wall sections of the structure connected to roof sections of the structure.
Figure 4A:
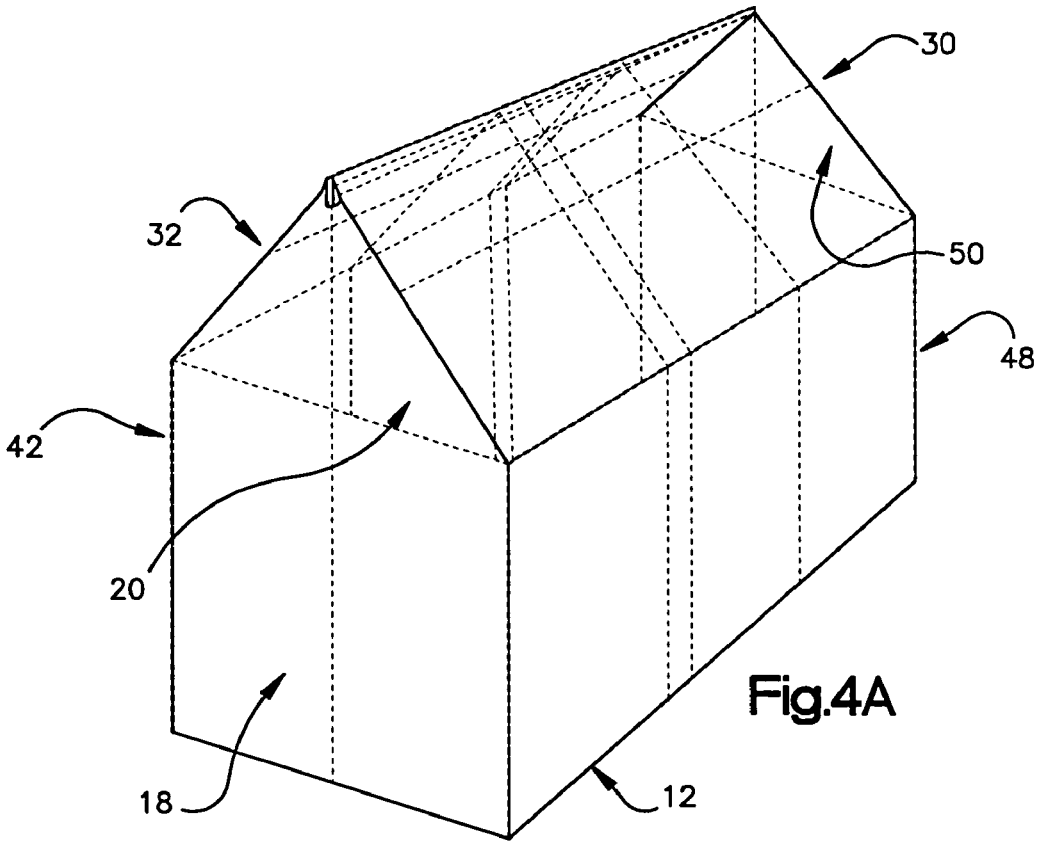
FIG. 4A shows the FIG. 1 structure configured with a gable roof with upper portions of end walls supporting the rake of the roof.
Figure 4B:
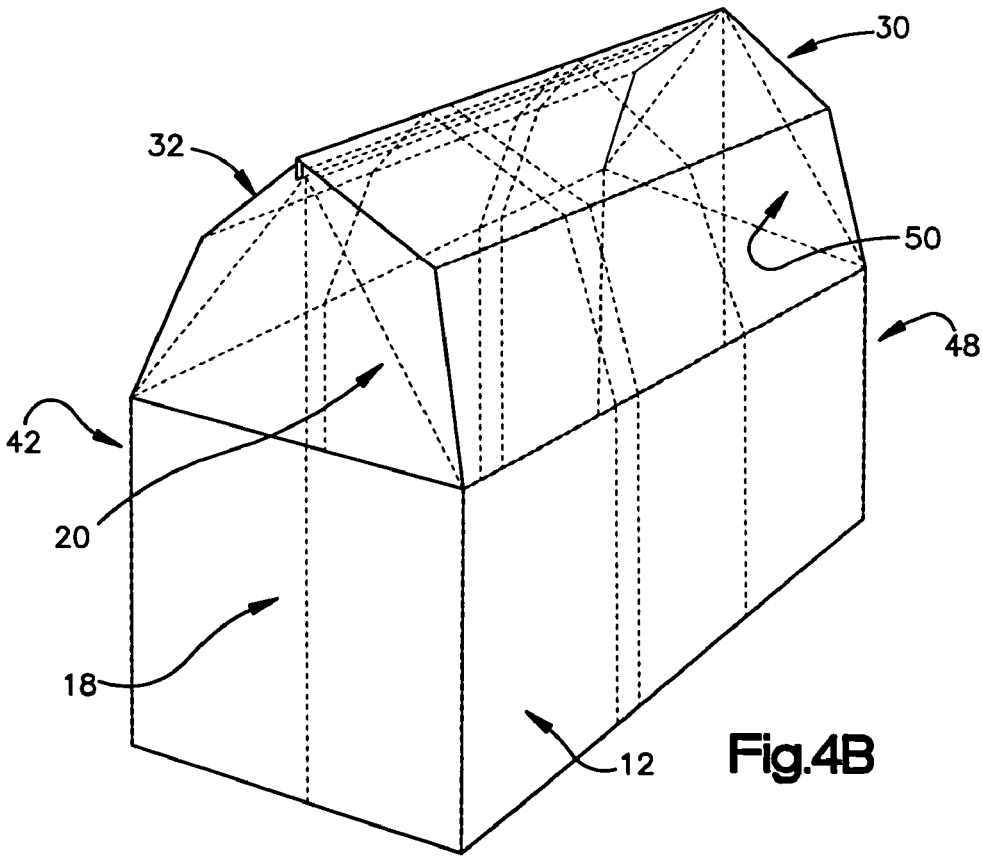
FIG. 4B shows the FIG. 1 structure configured as a gambrel roof with upper portions of end walls supporting the rake of the roof.
Figure 5:
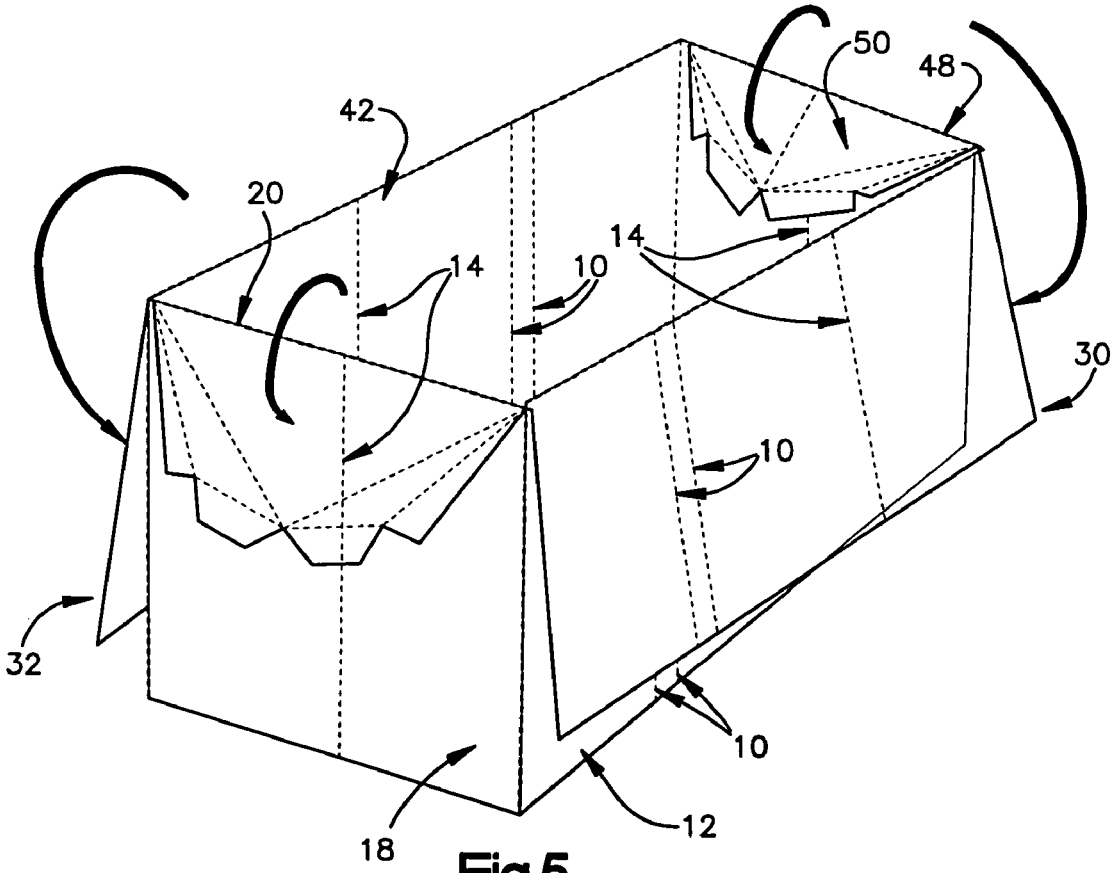
FIG. 5 shows the FIG. 1 structure in a partially collapsed condition, with the end walls and roof sections moved about their respective hinges, the roof sections and end walls being shown collapsed into respective storage positions.
Figure 6A:
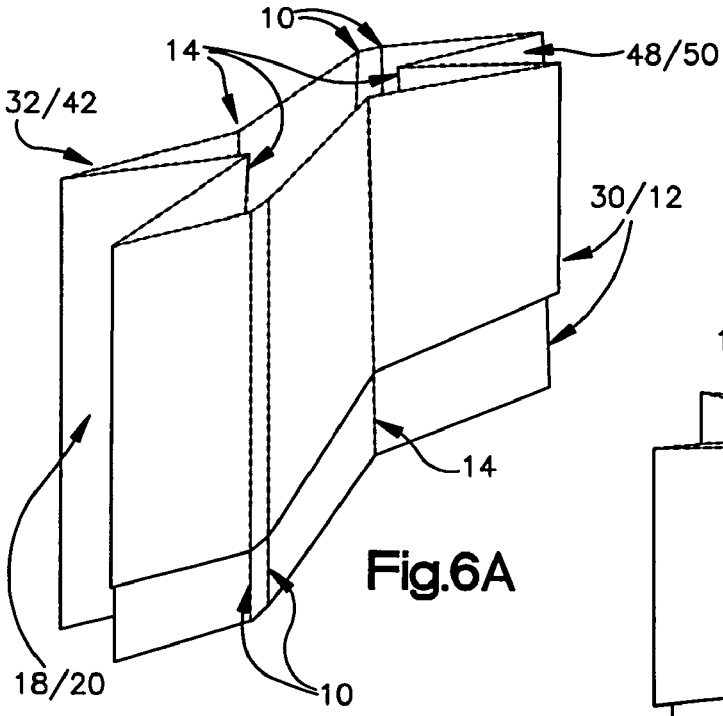
FIG. 6A shows the FIG. 1 structure further collapsed from the condition of FIG. 5, with the roof sections and end walls being further collapsed about their respective hinges.
Figure 6B:
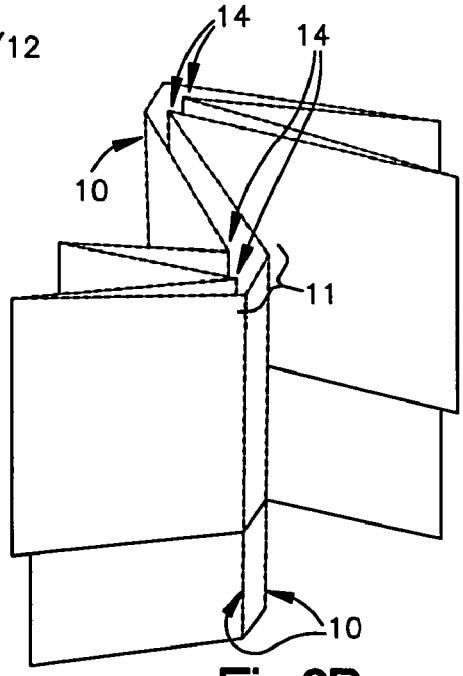
FIG. 6B shows the FIG. 1 structure further collapsed from the condition of FIG. 6A, whereby narrowly collapsed sections and pocket sections are formed due to the distance separating the hinges in the end walls and roof sections.
Figure 6C:
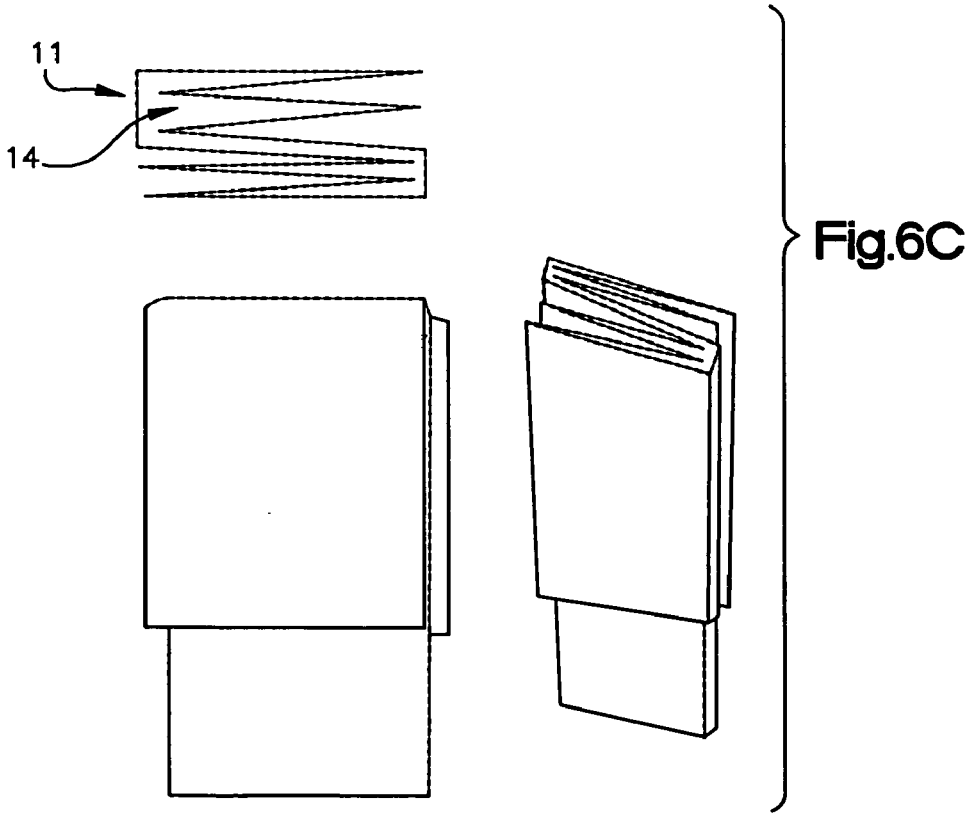
FIG. 6C shows top, side and perspective views of the FIG. 1 structure in a final collapsed form and with the top view thereof showing the relative position of narrow sections nested within pockets formed by the collapsed structure.

FIG. 3 shows a collapsible, foldable playhouse structure including wall panels 12, 18, 42, 48 that are connected to each other and roof panels 30, 32 which are connected to the wall panels 12 and 42. The completed collapsible playhouse structures shown in FIG. 4A and FIG. 4B show the upper portions 20, 50 of the two end walls 18, 48 lend support to two roof panels 30, 32. The roof 30, 32 and end walls 18/20, 48/50 are held in the expanded ready-for-use position by suitable fastening means, for example, glue, interlocking tabs and slots, and staples. The two side roof panels 30,32 connect at the peak with interlocking tabs and or other suitable fastening means. The collapsible playhouse structure may be collapsed as shown in FIG. 5 by folding the roof panels 30, 32 outward to rest against the outside surface of the wall panels 12, 42. The upper portion of the end wall panels 20, 50 may be folded either inward or outward so that they rest flat against respective lower portions of the end wall panels 18, 48. FIG. 6A illustrates how the roof/wall portions 30/12, 32/42 and end wall portions 18/20, 48/50 are then folded along hinges 10 and hinges 14 to create collapsing sections. FIG. 6B illustrates how a distance that accommodates the total thickness of one or more panels collapsing about hinges 14 separates the hinges 10 that create the pockets 11. FIG. 6C illustrates the natural nesting of the collapsing sections 14 within the pockets 11 upon further collapse of the structure.

A simple, releasable and reusable fastening device, which can accommodate changes in mating panels length, can be made an integral part a panel.

Figure 7B:
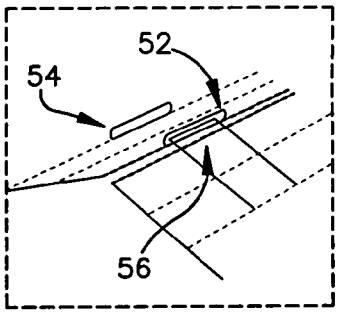
FIG. 7B shows a portion of the roof of the structure of FIG. 7A, with the tab inserted into a top-most slot, whereby the roof sections are configured to provide a full length roof.
Figure 7C:
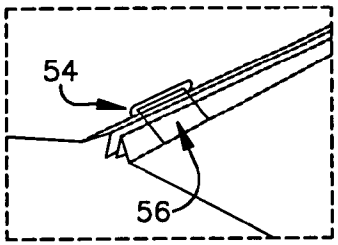
FIG. 7C shows a portion of the roof of the structure of FIG. 7A, with the tab inserted into a second slot, whereby the roof sections are configured to provide a roof of relatively shorter length than that of FIG. 7B.
Figure 7D:
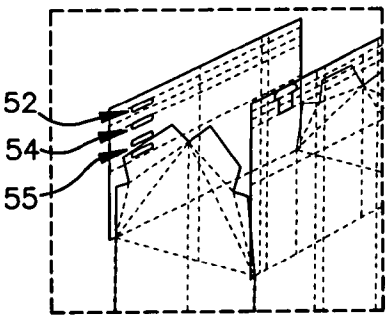
FIG. 7D shows a portion of a collapsible structure in accordance with the invention, with dashed lines representing hinges, the structure being shown with its roof open, the structure including an adjustable fastener including a tab and multiple slots which enable the structure to be assembled to have respective different length roofs.
Figure 7A:
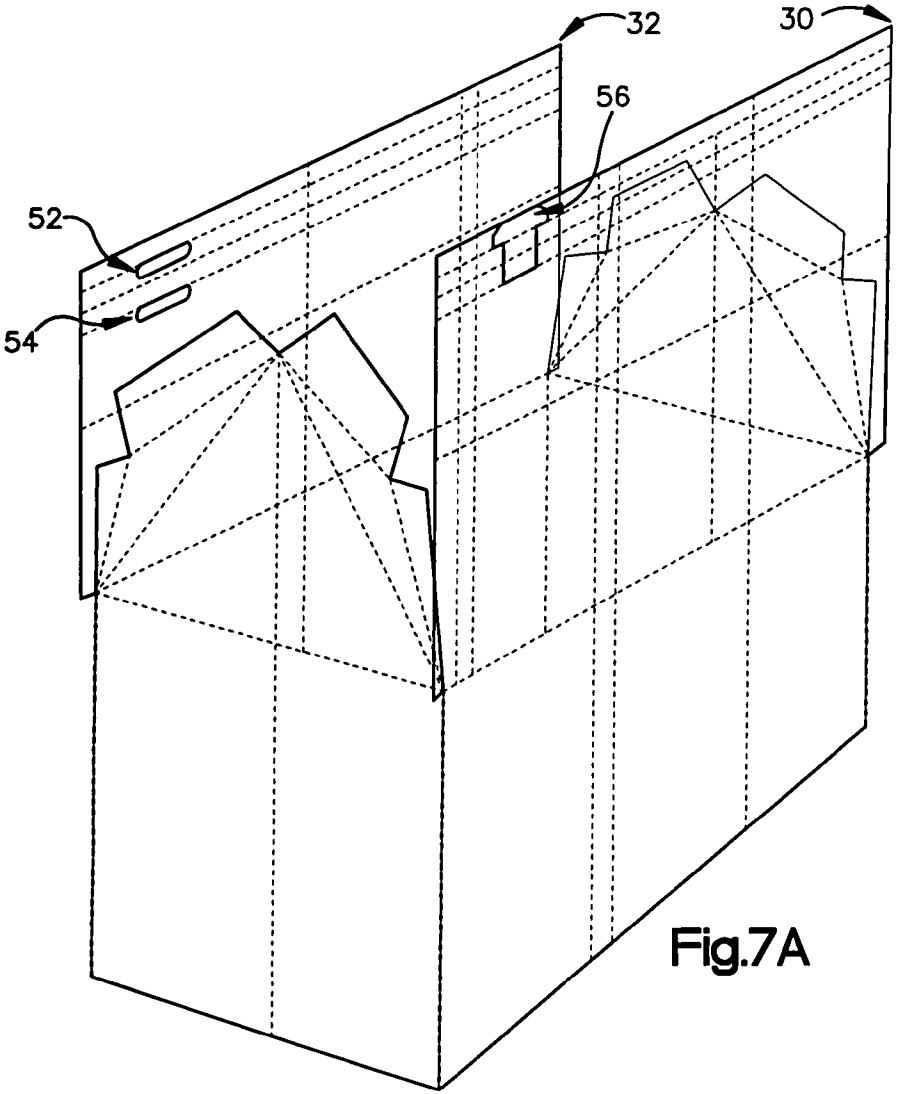
FIG. 7A shows a collapsible structure in accordance with the invention, with dashed lines representing hinges, the structure being shown with its roof open, the structure including an adjustable fastener including a tab and multiple slots which enable the structure to be assembled to have respective different length roofs.

The adjustable fastening device may be implemented to secure the playhouse roof panels as they are increased or decreased in length due to the configuration as a gambrel or gable roof. FIG. 7A illustrates an adjustable fastening means including multiple slots 52, 54 and a single tab 56 serving to fasten the roof panels 30, 32. When the roof panel is utilized at the maximum length FIG. 7B, tab 56 is inserted into slot 52. As the roof length is decreased FIG. 7C the tab is inserted into slot 54. Additional slots 55 can be added below slot 54 as needed to accommodate further decreases of panel lengths FIG. 7D.

Figure 8:
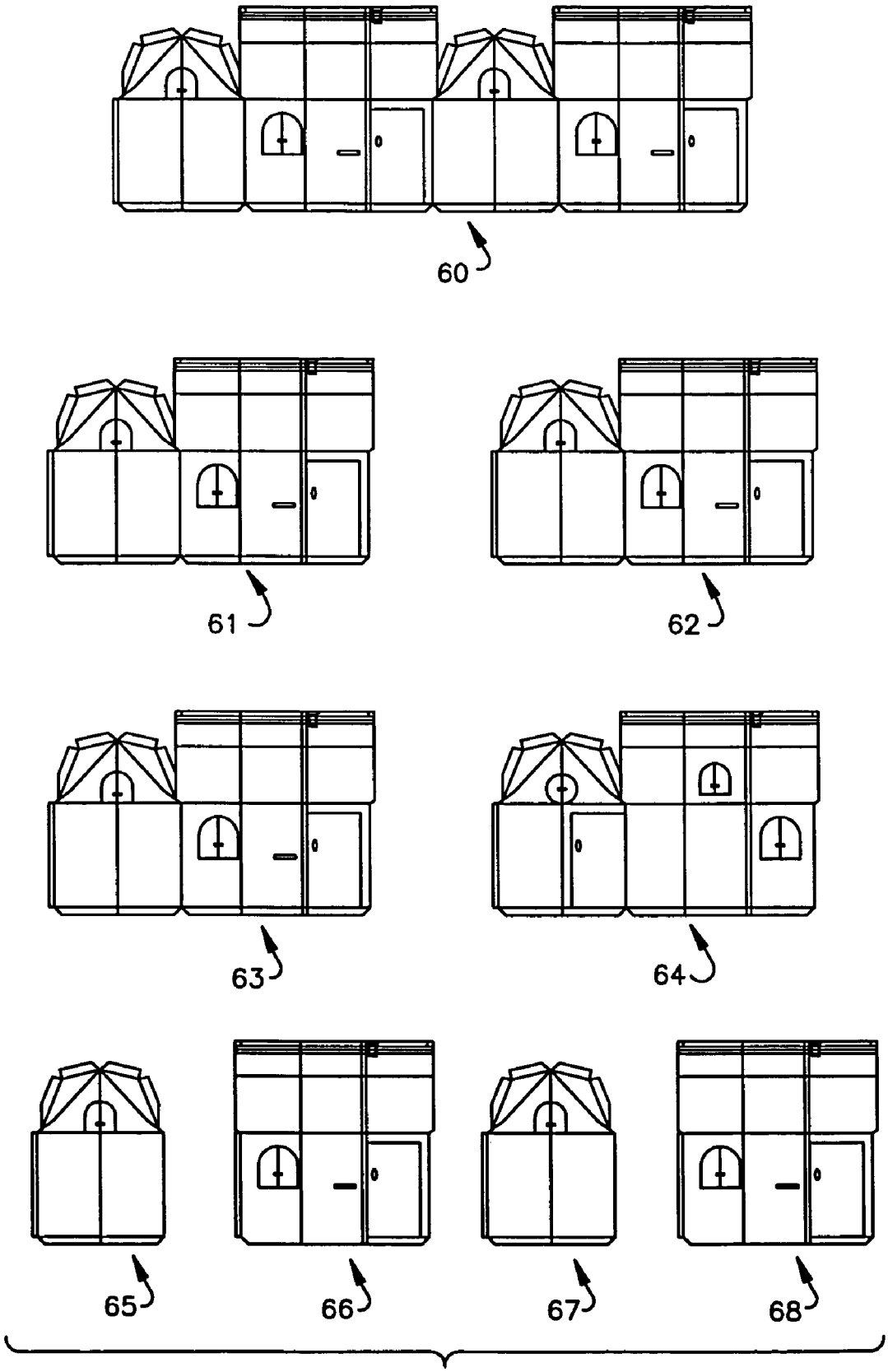
FIG. 8 shows different versions of blanks in accordance with the invention that can be used to create respective collapsible structures.
Figure 9:
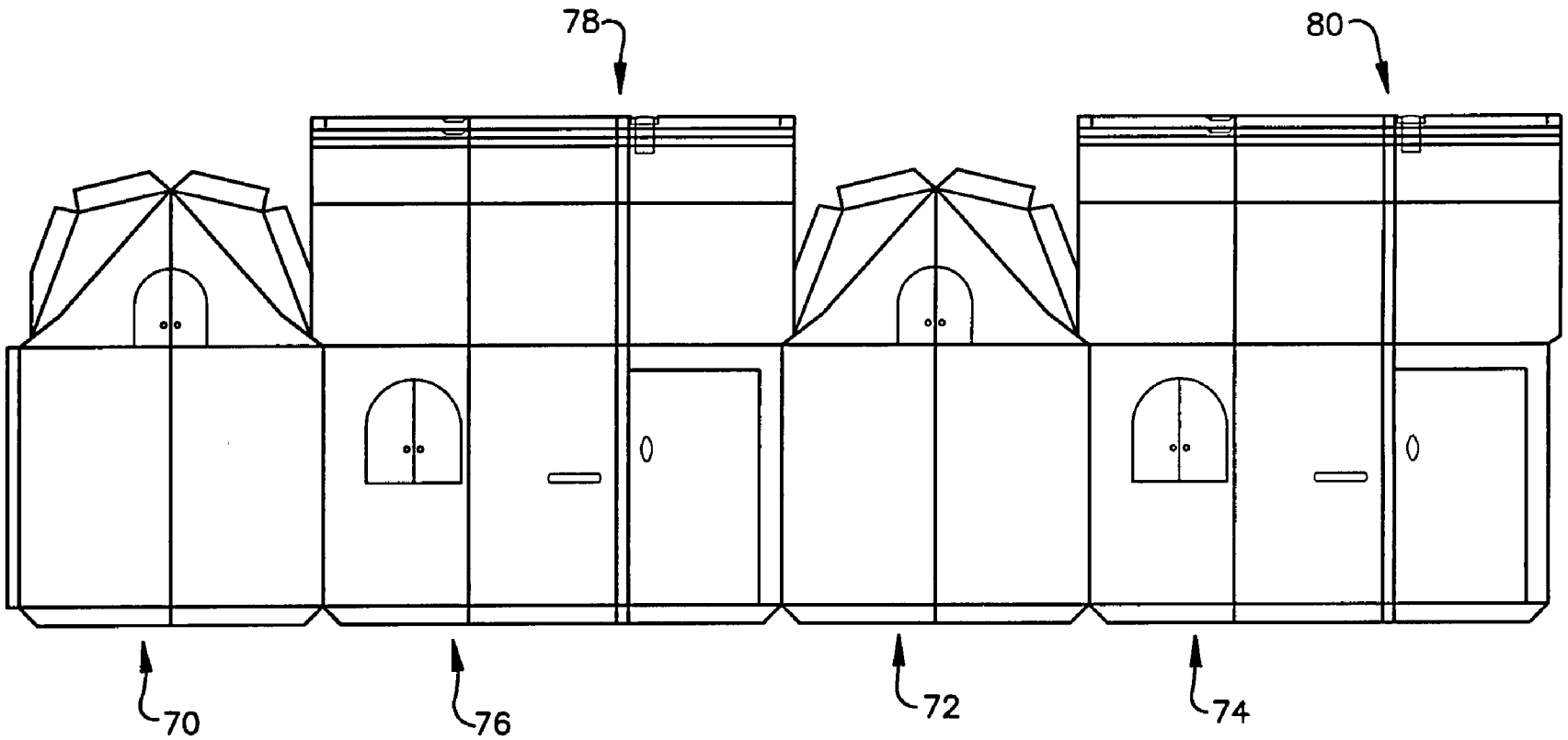
FIG. 9 shows a single blank in accordance with the invention, such blank being connectable to form a collapsible structure in accordance with the invention, the blank including end walls, side walls with connected roof sections, hinges for configuring the structure as a gable or gambrel roof, adjustable tab/multiple slot fastening means, hinges for creating pockets and narrowly collapsible sections that nest within the pockets.
Figure 10:
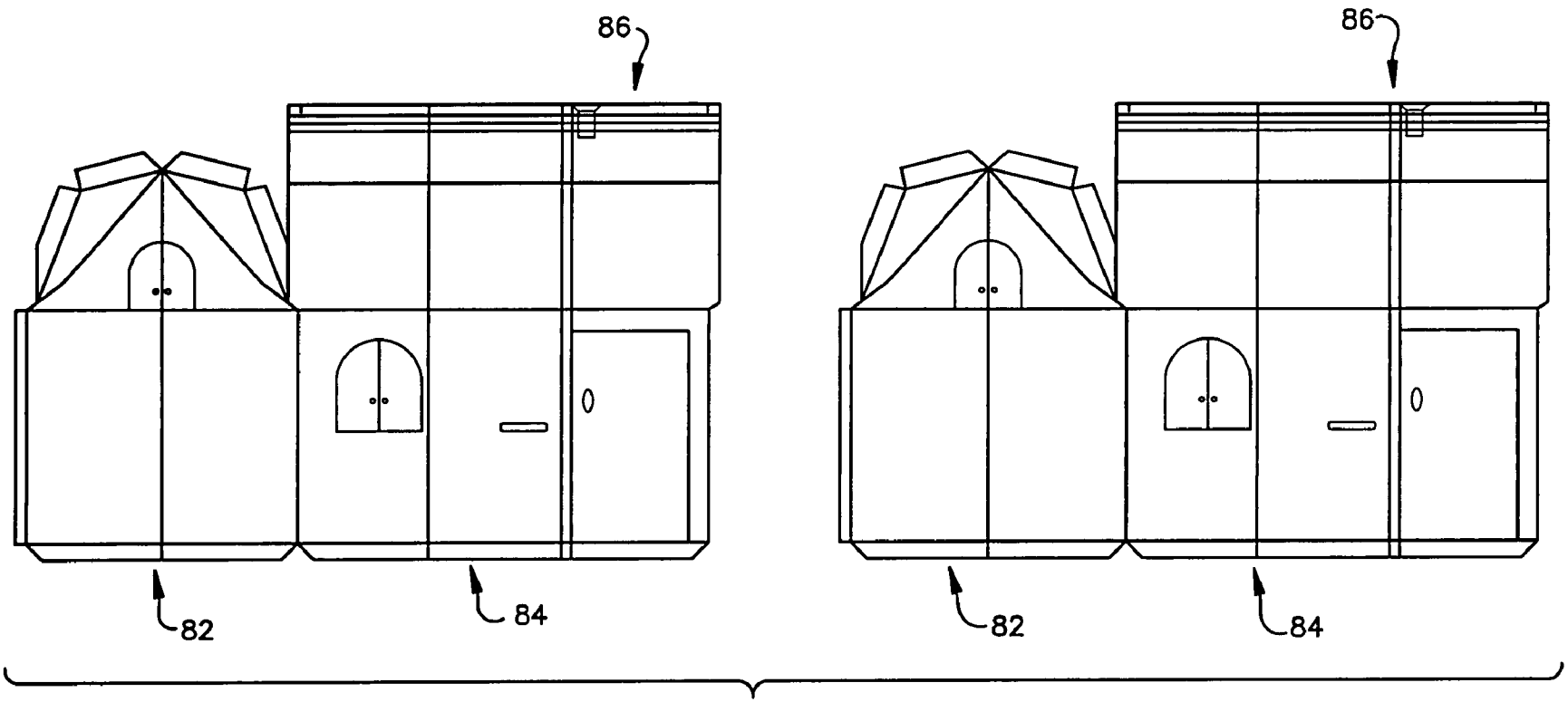
FIG. 10 shows two identical blanks in accordance with the invention, such blanks being connectable to form a collapsible structure in accordance with the invention, the blanks together including end walls, side walls with connected roof sections, hinges for configuring the structure as a gable or gambrel roof, adjustable tab/multiple slot fastening means, hinges for creating pockets and narrowly collapsible sections that nest within the pockets.
Figure 11:
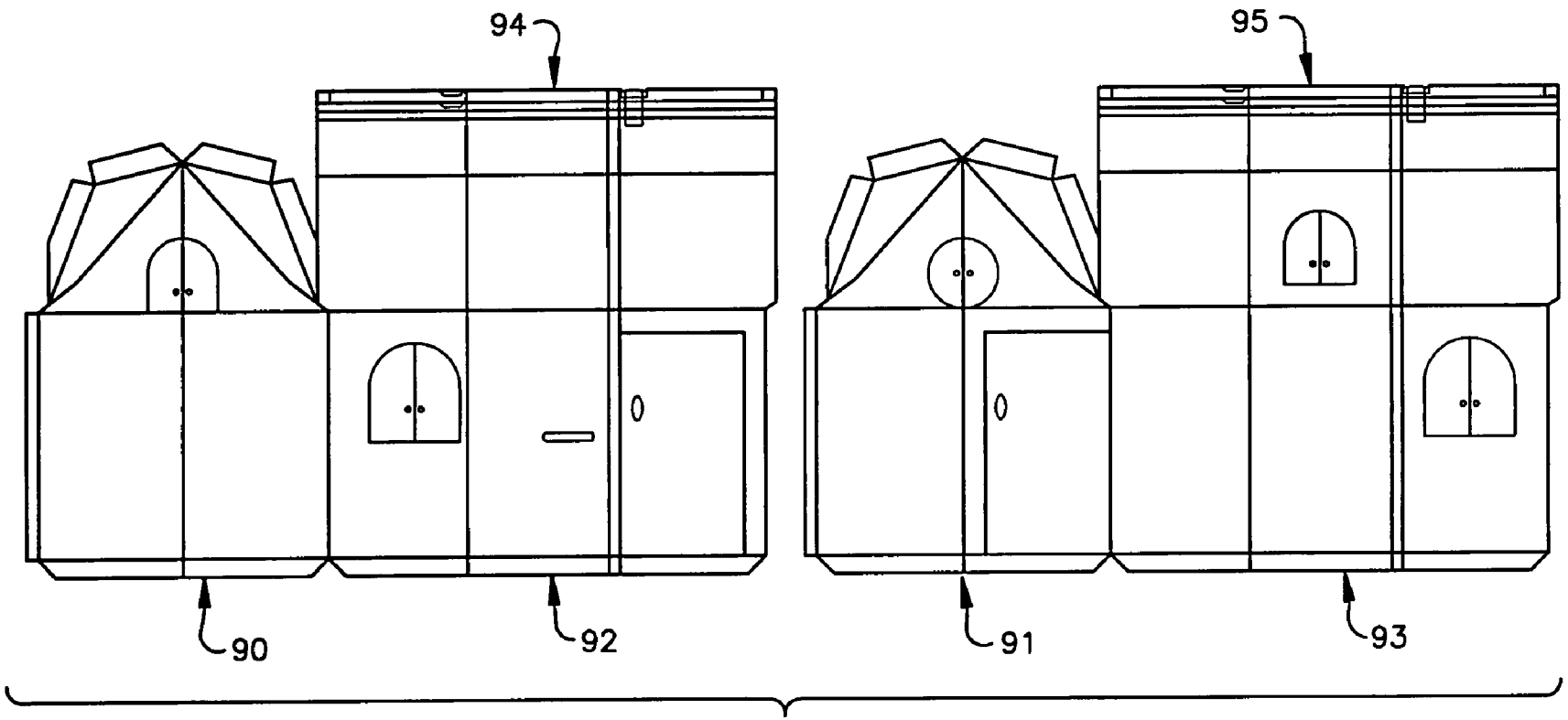
FIG. 11 shows two different blanks in accordance with the invention, such blanks being connectable to form a collapsible structure in accordance with the invention, the blanks together including end walls, side walls with connected roof sections, hinges for configuring the structure as a gable or gambrel roof, adjustable tab/multiple slot fastening means, hinges for creating pockets and narrowly collapsible sections that nest within the pockets.
Figure 12:
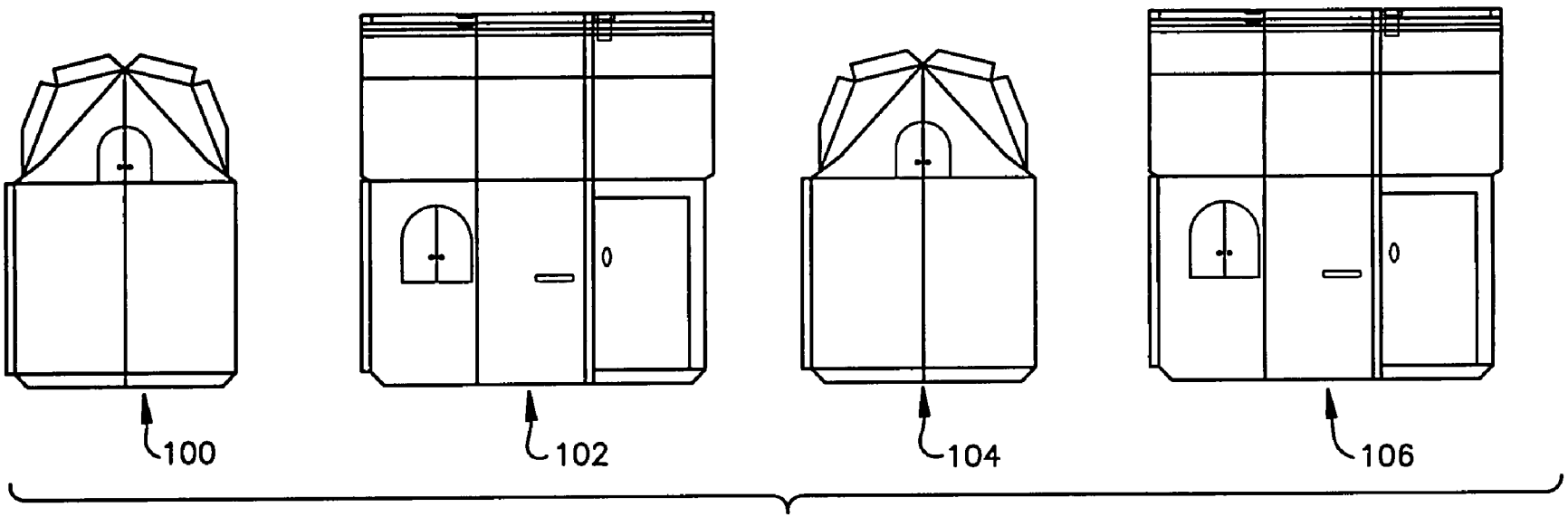
FIG. 12 shows four blanks in accordance with the invention, such blanks being connectable to form a collapsible structure in accordance with the invention, the blanks together including end walls, side walls with connected roof sections, hinges for configuring the structure as a gable or gambrel roof, adjustable tab/multiple slot fastening means, hinges for creating pockets and narrowly collapsible sections that nest within the pockets.

FIG. 8 illustrates how the design can be implemented using a single blank 60, two identical blanks 61, 62, two different blanks 63, 64, or multiple blanks 65, 66, 67, 68 each representing a section of the structure. For instance, a single blank FIG. 9 may include all north 70, south 72, east 74, west walls 76 and the roof panels 78, 80. Two identical blanks FIG. 10 may include two walls 82, 84 and one roof panel 86. Two different blanks FIG. 11 may include two walls and one roof panel but the two walls 90, 92 and roof panel 94 in one blank are different in structure as shown from the two walls 91, 93 and roof panel 95 of the second blank. Four blanks FIG. 12 where each blank contains a quadrant 100, 102, 104, 106 of the structure as shown and may have various or identical structure.

The blanks may be fastened by any suitable means for example glue, nails, tape, staples, tabs, either at the time of manufacture or assembly by the end user.

In an exemplary embodiment, two identical blanks of cardboard are glued to each other at the ends to create a collapsible play structure. Fastening the blanks at the time of manufacture reduces the end user assembly or disassembly time, effort, physical ability, and skill level requirements.

Figure 13:
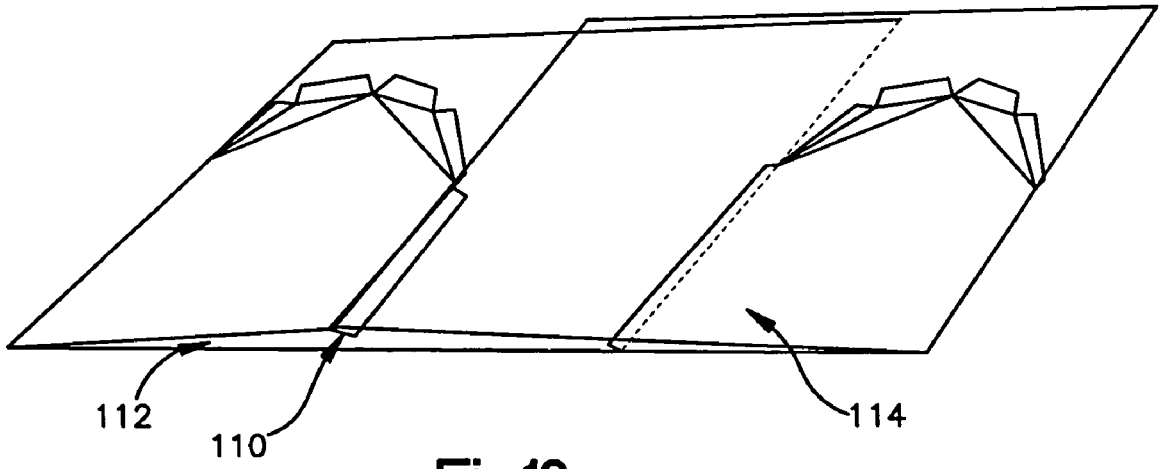
FIG. 13 shows two identical blanks connected together to create a collapsible structure in accordance with the invention, the collapsible structure being shown in a partially collapsed condition.
Figure 14A:
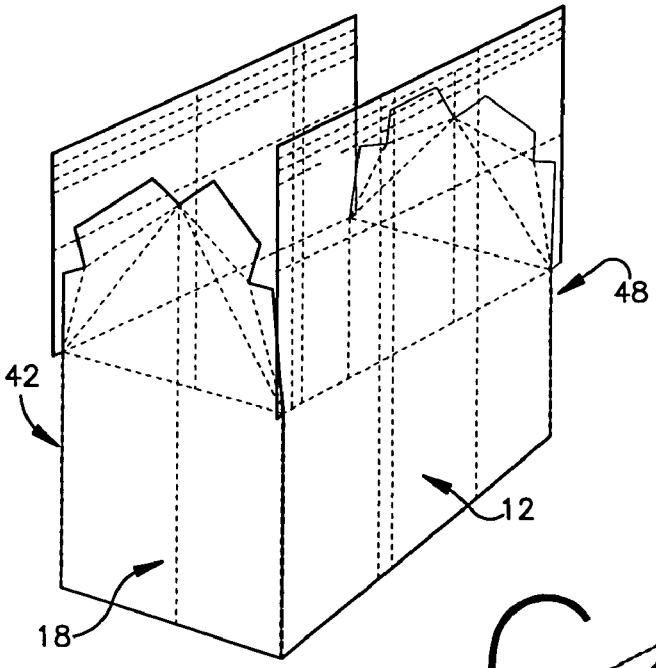
FIG. 14A shows the collapsible structure of FIG. 13, the structure including the blanks of FIG. 13 positioned so that the end-walls are parallel to each other and perpendicular to the side-walls, wherein dashed lines represent hinges, and wherein the structure is shown with its roof open.
Figure 14B:
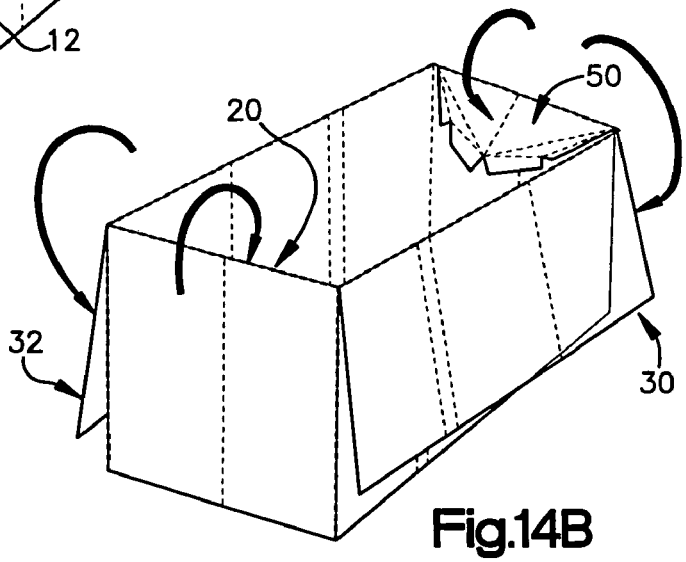
FIG. 14B shows the FIG. 14A structure in a partially collapsed condition, with the end walls and roof sections moved about their respective hinges, the assembled blanks' roof sections and end walls collapsed into respective storage positions.
Figure 14C:
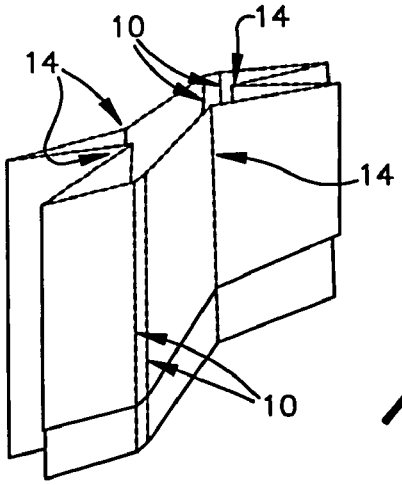
FIG. 14C shows the FIG. 14A structure further collapsed from the condition of FIG. 14B, with the roof sections and end walls being further collapsed about their respective hinges.
Figure 14D:
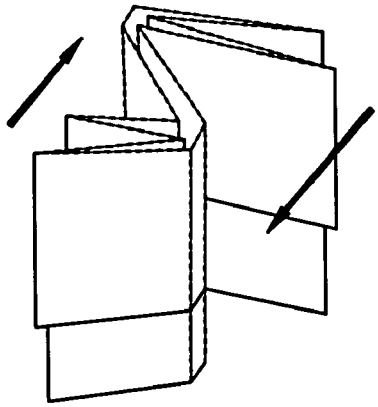
FIG. 14D shows the FIG. 14A structure further collapsed from the condition of FIG. 14C, whereby narrowly collapsed sections and pocket sections are formed due to the distance separating the hinges in the end walls and roof sections.
Figure 14E:
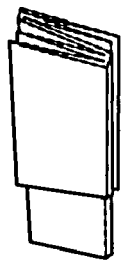
FIG. 14E shows the structure completely collapsed.

The identical blanks have integral glue tabs which when fastened form hinges and score lines to create the remaining hinges. First the blanks are folded FIG. 13 to enable the glue tab 110 of blank A 112 to overlap the end of blank B 114 and vice versa. After the glue tabs are secured the structure is opened so that the end walls 18,48 are parallel and side walls 12, 42 are parallel FIG. 14A. The roof panels 30, 32 and upper portions 20, 50 of the end walls 18, 48 are folded into respective storage positions FIG. 14B. FIG. 14C shows the collapsed sections are then folded along the hinges 14, 10 to form the narrow collapsed sections and pocket sections illustrated in FIG. 14D. The structure FIG. 14E is now collapsed and ready for shipment.

Figure 15A:
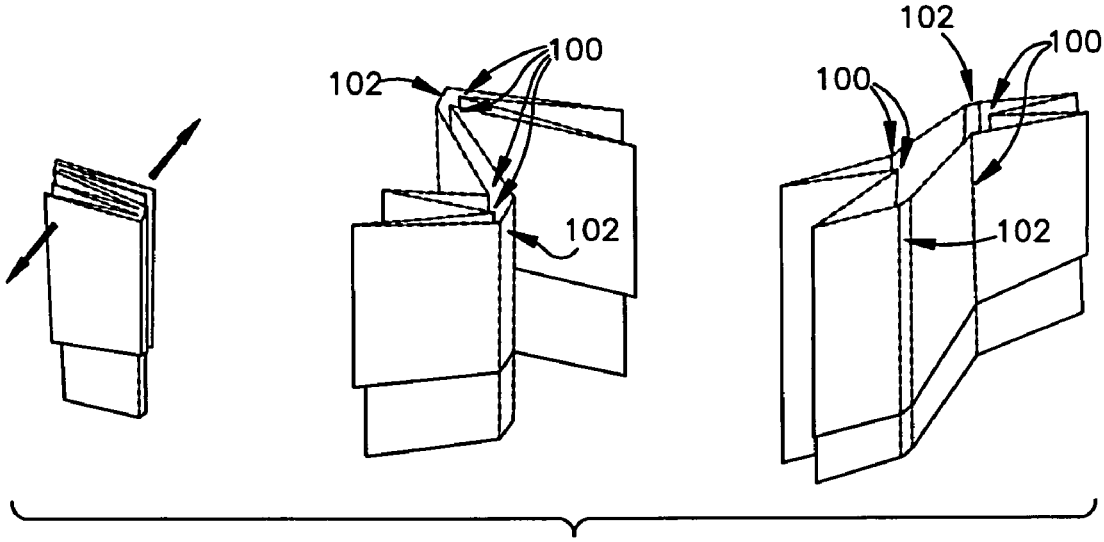
FIG. 15A shows multiple views of the collapsible structure being sequentially expanded from its final collapsed condition on the left to a partially expanded condition on the right.
Figure 15B:
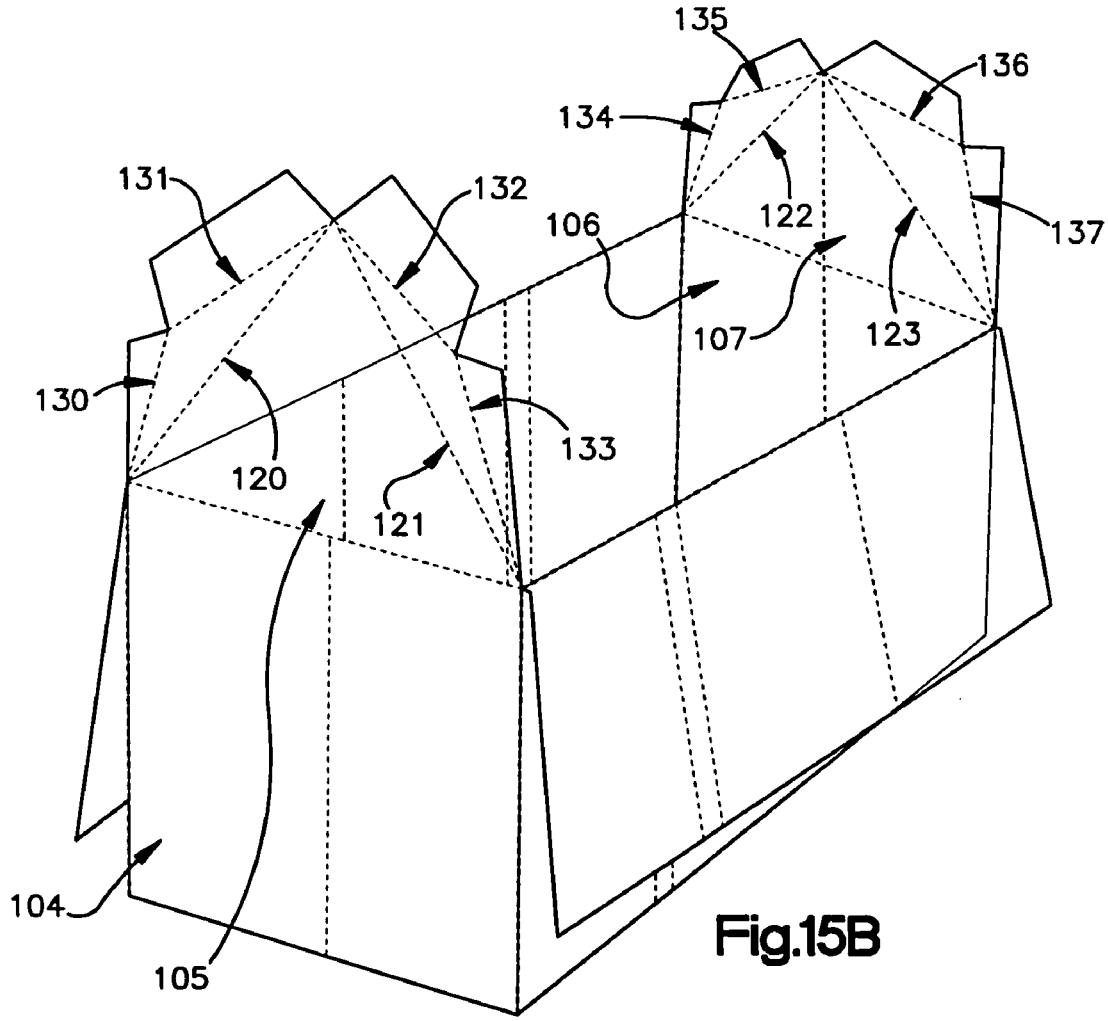
FIG. 15B shows the hinges used to configure the expanded structure's end walls so they will fit and support either a gable or gambrel roof line.
Figure 15D:
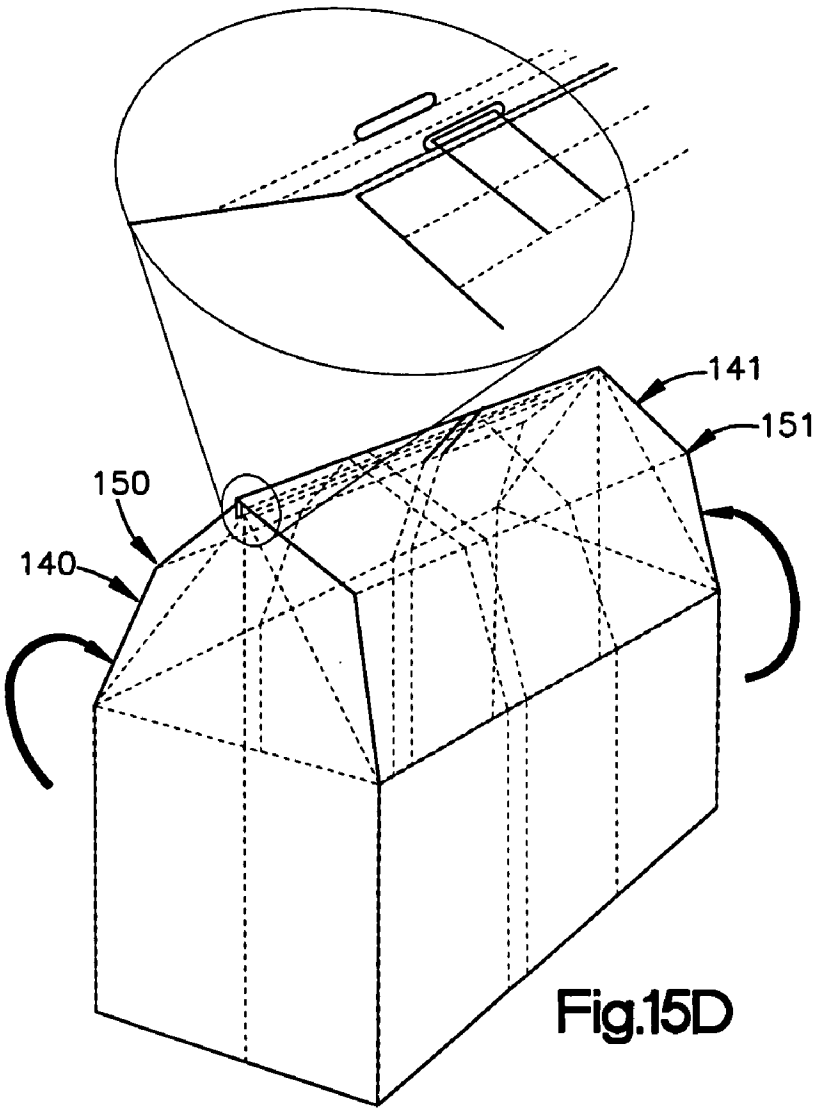
FIG. 15D shows the structure's roof sections being configured as a gambrel style and fastened using the tab/multiple slot method.
Figure 15C:
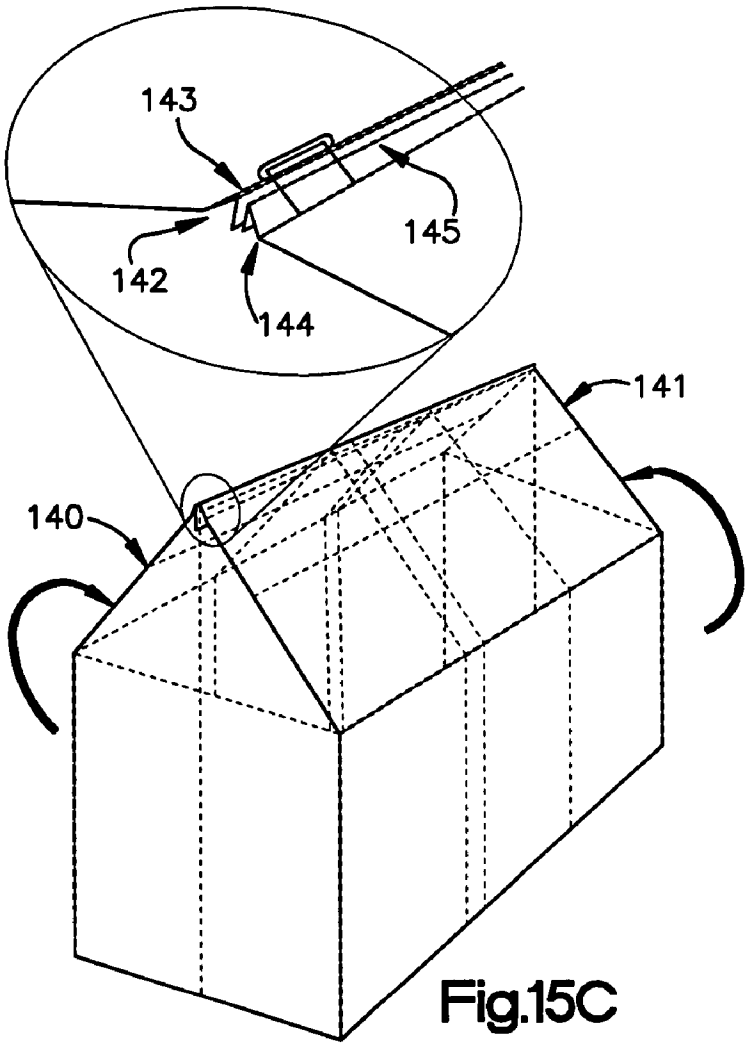
FIG. 15C shows the structure's roof sections being configured as a gable roof and fastened using the tab/multiple slot design.

The collapsed structure is easily setup using minimal folding motions followed by completion of a suitable fastening means. As the structure in FIG. 15A is expanded like an accordion the collapsed sections 100 escape from the pockets 102. FIG. 15B illustrates how the upper portions 105, 107 of the end walls 104, 106 are flipped up into position and configured for the desired roof style by using hinges 120, 121, 122, 123 for a gable roof line. Alternatively hinges 130, 131, 132, 133, 134, 135, 136, 137 are used for a gambrel roof line. FIG. 15C shows how the roof panels 140, 141 are flipped up into position and configured for gable configuration by using hinges 142, 143, 144, 145 or alternatively FIG. 15D shows the use of hinges 150, 151 for a gambrel roof line. The roof panels are connected to the end wall via suitable means. Roof panel 140 is secured to roof panel 141 via suitable fastening means, for example, by means of tabs as illustrated in FIG. 15C and FIG. 15D. The structure is now ready for use.

Figure 16C:
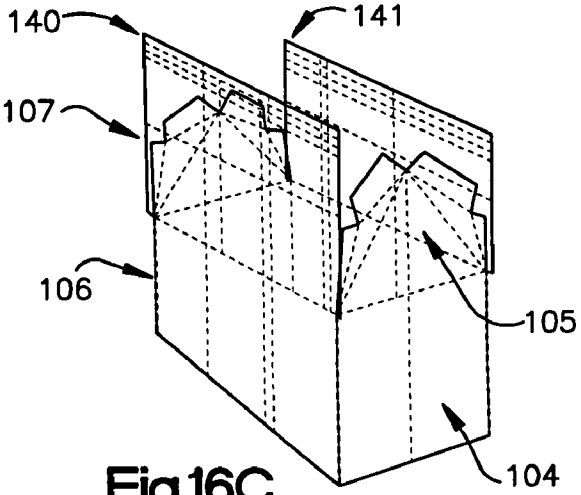
FIGS. 16C-16G sequential views of the FIG. 16A collapsible structure or the FIG. 16B collapsible structure being collapsed to FIG. 16C by disconnecting the roof sections and end walls, further collapsed to FIG. 16D by positioning the end walls and roof sections into their respective storage positions, further collapsed to FIG. 16E by compressing together the end walls and bending the side wall/roof sections along their respective hinges, further collapsed to FIG. 16F by forming the pockets and narrowly collapsed sections, and further collapsed to FIG. 16G by compressing the structure to the final collapsed form.
Figure 16B:
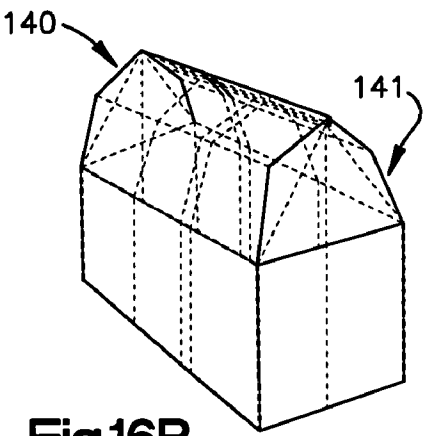
FIG. 16B shows a collapsible structure in accordance with the invention, with dashed lines representing hinges, the structure being shown with its roof assembled to form a gambrel roof style.
Figure 16A:
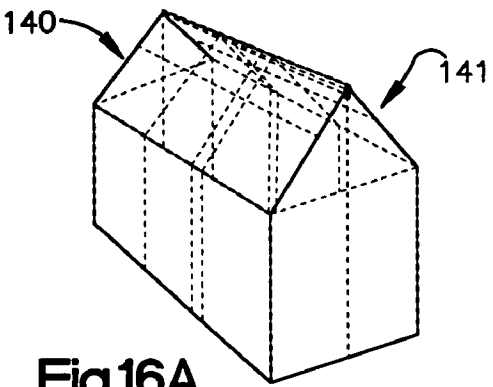
FIG. 16A shows a collapsible structure in accordance with the invention, with dashed lines representing hinges, the structure being shown with its roof assembled to form a gable roof style.
Figure 16G:
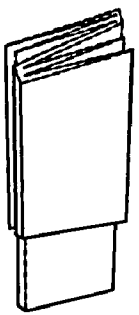
Figure 16F:
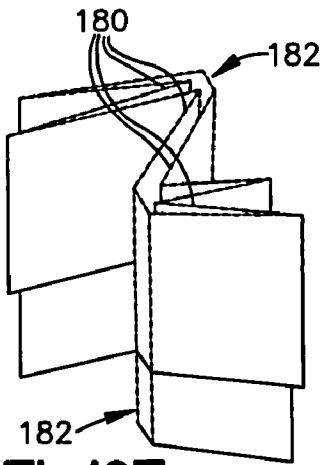
Figure 16E:
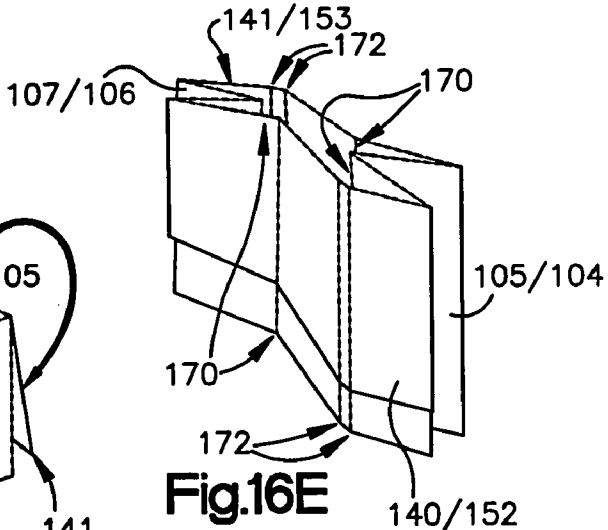
Figure 16D:
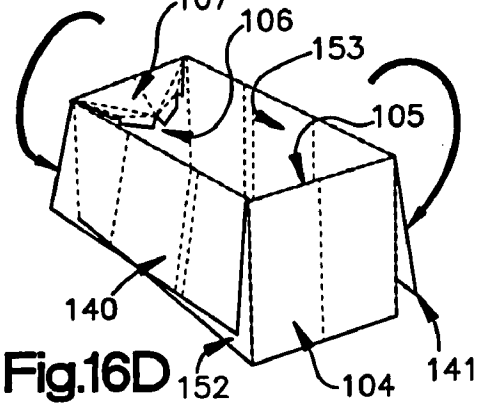

FIG. 16 illustrates how the structure is collapsed from either the gable configuration FIG. 16A or gambrel configuration 16B to the final form 16G, by removing the securing devices between roof panel 140 and roof panel 141. Then as shown in FIG. 16C separate the roof panels 140, 141 from the upper portions 105, 107 of the end wall panels 104, 106. As shown in FIG. 16D bring the roof panels 140, 141 to rest against the outside of attached walls 152, 153. Return the upper portions 105, 107 of the end wall to rest against the lower portions 104, 106 of the end walls. FIG. 16E shows how to fold the remaining side wall/roof sections 140/152, 141/153 and end wall upper/lower sections 105/104, 107/106 along the hinges 170 thereby creating collapsed sections 180 and hinges 172 creating pocket sections 182 as shown in FIG. 16F. Finish by nesting the collapsed sections 180 into the pocket sections 182. The structure is now in the collapsed configuration of FIG. 16G and ready for storage or shipment.

What is claimed is:

1. A collapsible structure comprising: second wall and the fourth wall are on opposite sides of the first wall;

wherein the second wall is adjacent a third wall and the first wall such that the third wall and the first wall are on opposite sides of the second wall;

wherein the third wall is adjacent the fourth wall and the second wall such that the fourth wall and the second wall are on opposite sides of the third wall;

wherein the fourth wall is adjacent the first wall and the third wall such that the first wall and the third wall are on opposite sides of the fourth wall;

wherein the four walls are connectable such that the first wall and the third wall are generally opposite and the second wall and the fourth wall are generally opposing;

wherein at least one of the four walls comprises at least three generally parallel hinges disposed between and spaced apart from the edges of the wall comprising the at least three hinges; and wherein the wall comprising the at least three generally parallel hinges is foldable at two of the hinges to form a pocket configured to receive at least part of another of the four walls; and wherein the side wall comprising the at least three hinges is foldable at the other of the three hinges for receipt of the other of the at least three hinges by a pocket on another wall.

2. The collapsible structure of claim 1 wherein the thickness of the pocket formed by two of the hinges is determined by the distance between the hinges.

3. The collapsible structure of claim 1 wherein the collapsible structure is manufactured from at least one of: wood, cardboard, steel, fiberboard, plastic, fabric covered frame, or coated material.

4. The collapsible structure of claim 1 wherein the walls are fastened together by at least one of: glue, nails, tape, staples, or tabs.

5. The collapsible structure of claim 1 wherein the collapsible structure is selected from the group consisting of: a temporary shelter, an animal shelter, a theater and a playhouse.

6. The collapsible structure of claim 1 wherein at least one of walls other than the wall having three generally parallel hinges comprises more than one hinge for forming one or more pockets.

7. The collapsible structure of claim 1 further comprising a roof.

8. The collapsible structure of claim 7 wherein each of the walls and the roof comprises one or more hinges, and wherein each of the walls and the roof is foldable at the one or more hinges to form a separate pocket.

9. A collapsible structure comprising hingedly connected end walls, side walls and a roof configurable to form a gable roof in one configuration and a gambrel roof in another configuration, wherein the roof is capable of being reconfigured from one of a gable roof or a gambrel roof to the other of a gambrel roof or a gambrel roof without creating new hinges and without adding or removing structure.

10. The collapsible structure of claim 9 wherein the at least one end wall, at least one side wall or at least part of the roof are foldable to form pockets, either individually or in combination.

11. The collapsible structure of claim 9 wherein the collapsible structure is manufactured from at least one of: wood, cardboard, steel, fiberboard, plastic, fabric covered frame, or coated material.

12. The collapsible structure of claim 9 wherein the collapsible structure is selected from the group consisting of: a temporary shelter, an animal shelter, a theater and a playhouse.

13. A collapsible structure comprising end walls, side walls, a roof, a plurality of hinges, multiple slots and at least one tab configured to engage a selected one the multiple slots without creating new hinges and without adding or removing structure, wherein at least two different configurations of the collapsible structure may be achieved by varying the selected one of the multiple slots engaged by the at least one tab without creating new hinges and without adding or removing structure, and wherein at least one end wall, at least one side wall, and at least part of the roof are each foldable to form pockets, either individually or in combination.

14. The collapsible structure of claim 13 wherein the pockets are configured to receive another of the at least one end wall, at least one side wall, or at least part of the roof.

15. The collapsible structure of claim 13 wherein the pockets are formed by multiple hinges.

16. The collapsible structure of claim 15 wherein the thickness of the pockets is determined by the distance between the hinges.

17. The collapsible structure of claim 13 wherein the collapsible structure is manufactured from at least one of: wood, cardboard, steel, fiberboard, plastic, fabric covered frame, or coated material.

18. The collapsible structure of claim 13 wherein the end walls, side walls and the roof are fastened together by at least one of: glue, nails, tape, staples, or tabs.

19. The collapsible structure of claim 13 wherein the collapsible structure is selected from the group consisting of: a temporary shelter, an animal shelter, a theater and a playhouse.

* * * * *

UNITED STATES PATENT AND TRADEMARK OFFICE

CERTIFICATE OF CORRECTION

PATENT NO. : 7,552,563 B2
APPLICATION NO. : 10/446899
DATED : June 30, 2009
INVENTOR(S) : Robert J. Becker It is certified that error appears in the above-identified patent and that said Letters Patent is hereby corrected as shown below:

Claim 1 erroneously reads in part:

1. A collapsible structure comprising: second wall and the fourth wall are on opposite sides of the first wall;

Claim 1 should properly read in part:

1. A collapsible structure comprising:
four walls;
wherein a first wall is adjacent a second wall and a fourth wall such that the second wall and the fourth wall are on opposite sides of the first wall;

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,552,563 B2
APPLICATION NO. : 10/446899
DATED : June 30, 2009
INVENTOR(S) : Robert J. Becker It is certified that error appears in the above-identified patent and that said Letters Patent is hereby corrected as shown below:

Column 5, lines 32-33:

Claim 1 erroneously reads in part:

1. A collapsible structure comprising: second wall and the fourth wall are on opposite sides of the first wall;

Claim 1 should properly read in part:

1. A collapsible structure comprising:
four walls;
wherein a first wall is adjacent a second wall and a fourth wall such that the second wall and the fourth wall are on opposite sides of the first wall;

This certificate supersedes the Certificate of Correction issued December 21, 2010.

Signed and Sealed this
Twenty-fifth Day of January, 2011

David J. Kappos

David J. Kappos
*Director of the United States Patent and Trademark Office*